US005084606A

United States Patent [19]

Bailey et al.

[11] Patent Number: 5,084,606

[45] Date of Patent: * Jan. 28, 1992

[54] ENCAPSULATED HEATING FILAMENT FOR GLOW PLUG

[75] Inventors: John M. Bailey, Dunlap; Carey A. Towe, Peoria; Scott F. Shafer, Peoria; Michael M. Blanco, Peoria, all of Ill.

[73] Assignee: Caterpillar Inc., Peoria, Ill.

[ * ] Notice: The portion of the term of this patent subsequent to Dec. 24, 2008 has been disclaimed.

[21] Appl. No.: 524,609

[22] Filed: May 17, 1990

[51] Int. Cl.[5] ..... F23Q 7/22

[52] U.S. Cl. ..... 219/270; 219/552; 219/553; 123/298; 123/145 A; 361/266

[58] Field of Search ..... 219/270, 260, 267, 505, 219/523, 553; 123/145 A, 145 R, 298; 361/264, 266

[56] References Cited

U.S. PATENT DOCUMENTS

| | | | |
|---|---|---|---|
| 3,065,436 | 11/1962 | Kayko et al. | 338/243 |
| 3,956,531 | 5/1976 | Church et al. | 427/226 |
| 4,426,568 | 1/1984 | Kato et al. | 219/270 |
| 4,476,378 | 10/1984 | Takizawa et al. | 219/270 |
| 4,502,430 | 3/1985 | Yokoi et al. | 123/145 A |
| 4,548,172 | 10/1985 | Bailey | 123/298 |
| 4,721,081 | 1/1988 | Krauja et al. | 123/298 |
| 4,786,781 | 11/1988 | Nozaki et al. | 219/270 |

FOREIGN PATENT DOCUMENTS

| | | |
|---|---|---|
| 352188 | 3/1961 | Switzerland . |
| 860466 | 2/1961 | United Kingdom . |
| 1094522 | 12/1967 | United Kingdom . |

OTHER PUBLICATIONS

Patent Abstracts of Japan, vol. 7, No. 165 (M-230) (1310), Jul. 20, 1983 & JP-A-58 72821, published, Apr. 30, 1983, By S. Nozaki.

U.S. application No. 07/386,064, Titled: Interference Connection Between a Heating Element and Body of a Glow Plug, filed Jul. 28, 1989, by Scott F. Shafer et al.

Exhibit A, by Kyocera Corp.

The Corrosion of Silicon Based Ceramics in a Residual Fuel Oil FIred Environment, by S. Brooks and D. B. Meadowcroft, Proceedings of the British Ceramics Society, 1978, No. 26, pp. 237-250.

Formulas for Stress and Strain, 5th edition, by R. J. Roark & W. C. Young, published 1975, McGraw-Hill Book Company, excerpts, pp. 582-585.

U.S. Application No. 07/524,610, Title: Heating Element Assembly for Glow Plug (assignee's copending application), Filed: May 17, 1990, by: Carey A. Towe et al.

*Primary Examiner*—Bruce A. Reynolds
*Assistant Examiner*—Tu Hoang
*Attorney, Agent, or Firm*—Anthony N. Woloch

[57] ABSTRACT

The service life of conventional glow plugs is extremely short when they are continuously energized at an elevated temperature during engine operation in order to assist ignition of non-autoignitable fuels. Such glow plugs typically fail due to thermal stresses and/or oxidation and corrosion.

Herein is disclosed an improved heating element assembly adapted for incorporation in a glow plug. The heating element assembly includes a monolithic sheath having a relatively-thin and generally annular wall defining a blind bore. The heating element assembly further includes a heating device positioned in the blind bore and adapted to emit heat, and a heat transfer device adapted to transfer heat from the heating means to the sheath. The heating device includes a heating filament and a ceramic insulator. THe heating filament is protected against oxidation by being encapsulated in the insulator. The insulator is protected against corrosion by being encapsulated in the sheath. The sheath is formed of a preselected material which is chosen and configured so as to minimize failure of the heating element assembly caused by thermal stresses, oxidation and/or corrosion.

15 Claims, 4 Drawing Sheets

ENCAPSULATED HEATING FILAMENT FOR GLOW PLUG

DESCRIPTION

1. Technical Field

The present invention relates generally to glow plugs and, more particularly, to heating element assemblies for such glow plugs.

2. Background Art

Until recent times, the technology of glow plugs, as applied to diesel internal combustion engines, has primarily evolved to satisfy the requirement of merely assisting the startup of such engines. In this application, it is understood that the diesel engines are burning autoignitable fuels.

Such conventional glow plugs are designed to be temporarily energized, by electrical-resistance heating, to a preselected moderately high temperature (for example, about 900° C./1650° F.) only during the brief period of starting. When cranking the engine during startup, atomized fuel sprayed from an injector contacts or passes in close proximity to the hot glow plug and ignition of the fuel is effected primarily by surface ignition. Because the rotational speed of the engine is quite slow during the cranking and startup phase, fuel remains in the vicinity of the glow plug for a relatively long time compared with normal engine operation. Consequently, the ignition of conventional fuel in a relatively cold engine is accomplished even at the above moderately high temperature. Once the engine is started, such glow plugs are deenergized and the engine continues to operate solely by autoignition of the fuel. Consequently, the deenergized glow plugs are allowed to cool down to a lower temperature which is approximately the engine mean cycle temperature (for example, about 675° C./1250° F.) during normal engine operation.

It has also been customary to preheat conventional glow plugs to the moderately elevated temperature prior to cranking and starting of the diesel engine. In commercial vehicles, such as earthmoving tractors or heavy-duty trucks, there used to be little concern about the time required (typically about one to two minutes) for preheating the glow plugs to the moderately elevated temperature. However, the increased application of diesel engines to light-duty trucks and passenger cars in recent years has caused a greater demand on being able to preheat the glow plugs in a much shorter period of time (typically about one to two seconds being considered acceptable). Thus, in recent years, the technological development of glow plugs has also focused on providing temporarily energizable glow plugs which require less time to preheat before the engine is cranked and started.

In response to scarce and dwindling supplies of conventional diesel fuel as well as the environmental need to develop cleaner burning engines, manufacturers have been developing engines which are capable of burning alternative fuels such as methanol, ethanol, and various gaseous fuels. However, such alternative fuels typically have a relatively low cetane number, compared to diesel fuel, and therefore are reluctant to ignite by mere contact with the heat of compressed intake air.

Applicants have been early leaders in the development of ignition-assisted engines which operate on the diesel cycle but which differ from conventional diesel or compression-ignition engines in that the ignition of the injected fuel and propagation of the flame is not effected primarily by the fuel contacting the heat of compressed intake air during normal engine operation. This hybrid type of engine having ignition-assist will hereinafter be generally referred to as a diesel-cycle engine.

As shown in U.S. Pat. No. 4,721,081 issued to Krauja et al. on Jan. 26, 1988 and U.S. Pat. No. 4,548,172 issued to Bailey on Oct. 22, 1985, one way of facilitating ignition of such fuels is to provide an ignition-assist device which extends directly into the engine combustion chamber. For example, the ignition-assist device may include a continuously energized glow plug which is required to operate at a very high preselected temperature throughout engine operation. For example, such very high preselected temperature may be about 1200° C./2192° F. in order to ignite the above mentioned alternative fuels.

Applicants initially tried to use conventional glow plugs in this application. One type of conventional glow plug is generally shown in U.S. Pat. No. 4,476,378 issued to Takizawa et al. on Oct. 9, 1984. This glow plug has a heating element assembly consisting of a wire filament wound as a single helix around a mandrel which is positioned in a blind bore of a sheath. The sheath is made of heat resistant metal such as stainless steel. The remaining space in the blind bore is then filled with a heat resistant electric insulating powder such as magnesia. In order to compress the heat resisting electrically insulating powder tightly around the filament for providing adequate support of the filament wire and for effecting adequate heat transfer to the metal sheath, the sheath is normally swaged inward to decrease its inside diameter and thereby compact the powder. One end of the filament at the bottom of the blind bore is connected to the metal sheath so that the metal sheath forms part of the electrical circuit.

Applicants found that a glow plug sheath formed from commercially feasible metallic materials is too vulnerable to oxidation and corrosion attack if it is continuously heated in the and exposed to an engine combustion chamber. The sheath is severely attacked by impurities, such as sodium, sulfur, phosphorus and/or vanadium, which enter the combustion chamber by way of fuel, lubrication oil, ocean spray and/or road salt. The metallic sheath is eaten away by these impurities so that the wire filament becomes exposed. The exposed wire filament is then subject to oxidation and corrosion attack and quickly fails.

Another type of conventional glow plug is generally shown in U.S. Pat. No. 4,502,430 issued to Yokoi et al. on Mar. 5, 1985. In this glow plug, the heating element assembly has a spirally-wound wire filament formed from tungsten or molybdenum which is bent in a generally U-shape. The wire filament is embedded in a ceramic insulator formed from silicon nitride ($Si_3N_4$). This design is advantageous for the construction of a ceramic glow plug not only because this ceramic material is an electrical insulator but also because this material can be hot pressed to effect good heat transfer from the filament to the ceramic material. In addition, silicon nitride possesses appropriate physical properties such as high strength, low coefficient of thermal expansion, high Weibull modulus and high toughness to permit the glow plug tip to survive the severe thermal and mechanical loadings imposed by the engine cylinder.

This glow plug design exhibits satisfactory life when the heating element assembly is electrically energized only during engine startup to effect ignition of the fuel in a conventional diesel engine. However, Applicants have found that this heating element assembly exhibits an unacceptably short life, for example about 250 hours, when operated continuously to effect ignition of methanol fuel in diesel-cycle engines operating in highway trucks. Similar to the metallic sheaths discussed above, the hot surface of the silicon nitride heating element assembly is vulnerable to severe oxidation and corrosion attack from impurities such as sodium, vanadium, phosphorus and/or sulfur. The silicon nitride covering is eaten away by these impurities so that the wire filament becomes exposed. The exposed wire filament is then subject to oxidation and corrosion attack and quickly fails.

Another type of known glow plug is disclosed in U.S. Pat. No. 4,786,781 issued to Nozaki et al. Nov. 22, 1988. In this arrangement, a heating element has a generally U-shaped tungsten filament embedded in a silicon nitride insulator similar to that shown in Yokai et al. However, the silicon nitride insulator is then covered, using a process called chemical vapor deposition, with a coating of highly heat and corrosion resistant material, such as alumina ($Al_2O_3$), silicon carbide (SiC) or silicon nitride ($Si_3N_4$) in an attempt to minimize erosion and corrosion due to combustion gases.

While this reference avers that the coating adequately protects the filament and silicon nitride covering shown in this glow plug against oxidation and corrosion attack, it has been Applicants' experience that ceramic coatings typically exhibit durability problems when they are applied to a glow plug heating element assembly which is continuously energized at a high temperature. If the coating is applied as a relatively thin layer, the coating quickly disappears from the heating element assembly due to the effects of corrosion and erosion. On the other hand, if the coating is applied as a relatively thick layer, the coating quickly flakes off the heating element assembly. Applicants believe such failure is caused primarily by unacceptably high thermal stresses, that are induced in the thick coating, as well as insufficient bonding of the coating to the insulator.

The present invention is directed to overcoming one or more of the problems as set forth above.

DISCLOSURE OF THE INVENTION

In one aspect of the present invention an improved heating element assembly is disclosed which is adapted for a glow plug. The heating element assembly includes a monolithic sheath, a heating means for emitting heat, and a heat transfer means for transferring heat from the heating means to the sheath. The sheath includes a relatively-thin and generally annular wall, having a closed end portion, which defines a blind bore. The heating means includes a heating filament which is sealed in a ceramic insulator. The heating means is positioned in the blind bore and is adapted to be connected to a source of energy.

The improved heating element assembly may be used to effect ignition of fuel burned in various types of combustors. For example, the improved heating element assembly is particularly advantageous for use in diesel-cycle engines which (i) normally operate on low cetane fuels; or (ii) have a relatively low compression ratio; or (iii) which operate for substantial periods of time under cold conditions or conditions which result in marginal autoignition. In each of the above examples, autoignition of fuel is marginal. In order to achieve efficient engine performance, the subject heating element assembly is provided to assist fuel ignition and is capable of being energized either continuously or for extended periods. The subject heating element assembly may also be used in other combustion applications, such as industrial furnaces, where a relatively durable surface-ignition heating element is required for initiating or assisting the ignition and combustion of fuels.

BEST MODE FOR CARRYING OUT THE INVENTION

Figure 1:
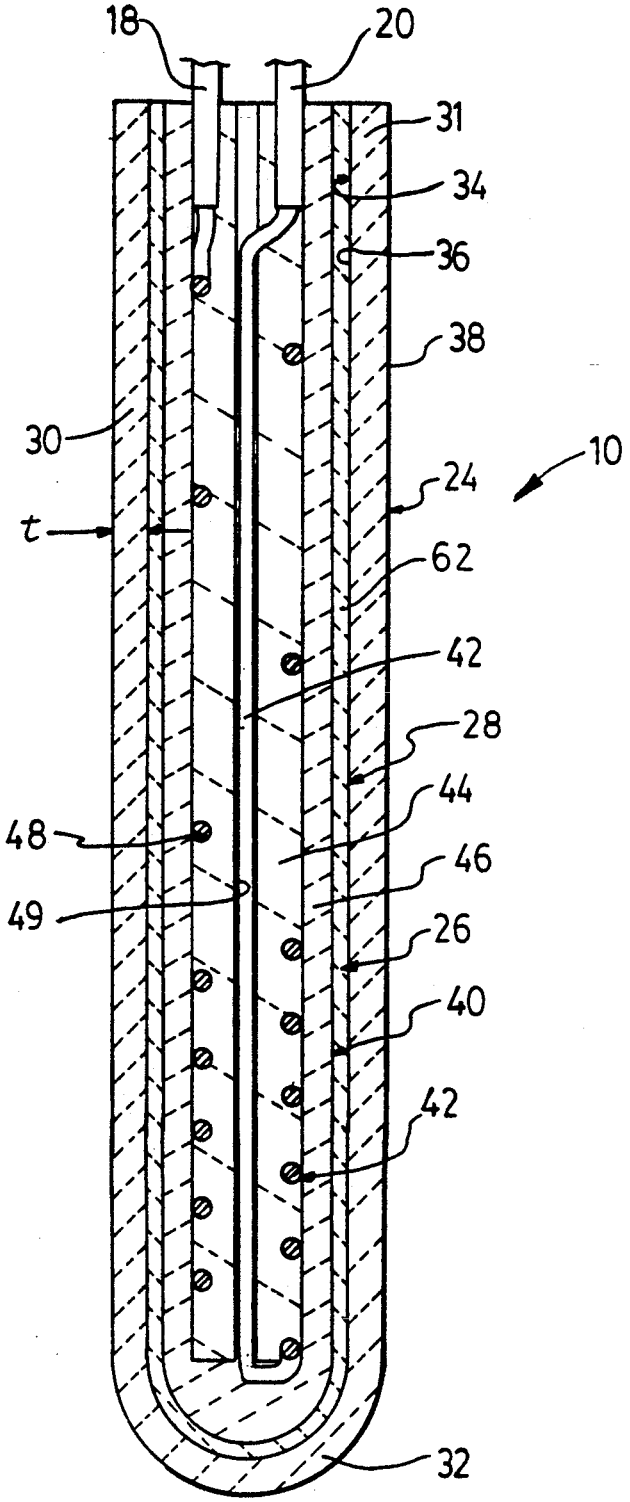
FIG. 1 is a diagrammatic cross-sectional view of a first exemplary embodiment of the present invention.

In FIGS. 1–4, similar reference characters designate similar elements or features throughout the figures. While there are many other uses for reliable, very high temperature heating element assemblies of the present invention, the principal use driving the technological development of this invention has been to effect or assist ignition of fuel on a continuous basis during all or a substantial portion of the normal operation of a diesel-cycle engine. For illustrative purposes, the specification will focus on this use.

In FIG. 1, a first exemplary embodiment of an improved heating element assembly 10 is shown adapted for connection to an electrically energizable glow plug (not shown). Preferably, the heating element assembly 10 includes a pair of relatively large diameter lead wires 18, 20 which are adapted to be connected to an electrical source of energy. The heating element assembly 10 is preferably sealingly connected to a body of the glow plug by a compression fit with the ferrule as disclosed in Assignee's copending U.S. patent application Ser. No. 07/386,064 filed on Jul. 28, 1989. Alternatively, the heating element assembly 10 may be sealingly connected to the glow plug body by brazing or another conventional fastening technique. The subject invention specifically relates to the heating element assembly per se, and the discussion which follows will focus on various exemplary embodiments and methods of manufacturing it.

As shown in FIG. 1, the heating element assembly 10 includes a refractory, corrosion-resistant, substantially-gas-impermeable, ceramic sheath 24, a heating means or device 26 for emitting heat within the sheath 24, and a heat transfer means or device 28 for transferring heat from the heating means 26 to the sheath 24.

The sheath 24 per se is hollow and includes a relatively-thin and generally annular wall 30. The annular wall 30 has an open end portion 31 and an oppositely disposed closed end portion 32 which collectively define a blind bore or cavity 34 of the sheath 24. The annular wall 30 includes an inner peripheral surface 36 and an outer peripheral surface 38 which are both substantially imperforate to the flow of gaseous fluids. Preferably, the inner and outer peripheral surfaces 36,38 are cylindrically-shaped, substantially smooth, and gradually rounded or radiused at the closed end portion 32 so that they are substantially free of stress concentrators. The annular wall 30 has a thickness extending transversely between the inner and outer peripheral surfaces 36,38 which, preferably, is generally uniform along the length of the sheath 24.

The sheath 24 is a monolithic (i.e., single) piece formed of a carefully selected material. Suitable materials for the sheath 24 are selected in accordance with a new design methodology that is not taught by the prior art of glow plugs.

A primary function of the sheath 24 is to protect the heating means 26 from attack by corrosive gases present in the engine combustion chamber. In order to help accomplish this function, the sheath 24 must be able to resist attack by such corrosive gases while the sheath 24 is continuously heated at a preselected very high temperature (for example, about 1200° C./2192° F.). Applicants recognized a need for much more durable glow plugs after Applicants tried to use conventional glow plugs to assist ignition of relatively low cetane fuels in diesel-cycle engines. When attempting to use silicon nitride glow plugs of the type shown in the Yokoi patent, it was found that the silicon portion oxidized and the resultant silicon dioxide reacted with the impurities present in the combustion chamber to form compounds which have a much lower melting point. For example, the silicon dioxide reacts with sodium impurities to form sodium silicate. Sodium silicate formed bubbles which then melted or broke off. This process eats away the silicon nitride and exposes the heating filament to oxidation and/or other forms of corrosion which eventually create a broken electrical circuit.

Applicants found from published literature relating to gas turbine components that a similar corrosive process had been identified where the components were made from silicon nitride and were required to operate at high temperatures for long periods of time. The published literature also disclosed a corrosion test in which silicon nitride specimens were immersed in molten sodium sulfate.

Applicants subjected pieces of a conventional silicon nitride glow plug heating element assembly to this corrosion test and observed that the nature of the corrosion was similar to that experienced by such glow plugs actually operating in in an engine combustion chamber. Applicants are convinced that the corrosion process which attacks conventional ceramic glow plugs in an internal combustion engine is caused by sodium and other impurities which are present in the engine combustion chamber during operation.

Applicants used the following corrosion test to evaluate various candidate ceramic materials. Ceramic samples were weighed and then submerged in molten sodium sulfate ($Na_2SO_4$) at about 1200° C./2192° F. for up to 100 hours. A platinum crucible was used to contain the materials. A twenty to one ratio (by weight) of sodium sulfate to ceramic material was used. Afterwards, the sodium sulfate was dissolved. The dried ceramic material was then weighed, and the weight loss was calculated. The results of corrosion tests on various materials are shown in the following table:

| CERAMIC MATERIAL | TIME (HOURS) | % WEIGHT LOSS |
|---|---|---|
| Silicon Nitride [$Si_3N_4$] | <25 | 100 |
| Sialon [SiAlON] | <25 | 100 |
| Aluminum Oxide [$Al_2O_3$] | 100 | nil |
| Aluminum Oxide with Silicon Carbide whiskers [$SiC_w$—$Al_2O_3$] | 100 | nil |
| Mullite [$3Al_2O_32SiO_2$] | 100 | nil |
| Cordierite [magnesium aluminosilicate] | 25 | nil |
| Aluminum Titanate [$Al_2TiO_5$] | 25 | nil |
| Beryllium Oxide [BeO] | 100 | nil |

The above results show that ceramics of the oxide family are hardly affected by the corrosion test while ceramics of the nitride and oxynitride families are severely attacked. Applicants believe that there are potentially many other oxide ceramics, not listed above, which would also pass the corrosion test.

A suitable sheath material must also have substantially no gas permeability. This property is important to help ensure that the sheath 24 effectively seals the heating means 26 from contact with the corrosive gases present in an operating engine combustion chamber. Preferably, the permeability of the sheath 24 is on the order of the atomic diffusion coefficient (for example, a gas permeability coefficient of about 0.0000001 darceys).

Finally, the candidate material must possess properties that will ensure that it does not fail due to thermal and/or mechanical stresses. Heat must flow outwardly through the annular wall 30 of the sheath 24 at a rate which both compensates for the heat lost from the heating element assembly 10 (via conduction to the glow plug body, radiation and convection) and elevates the temperature of the outer peripheral surface 38 to the preselected very high temperature (for example, about 1200° C./2192° F).

Heat flux is generally defined as the rate of transfer of heat energy through a given area of surface. The heat flux through the annular wall 30 of the sheath 24 causes the temperature of the inner peripheral surface 36 to exceed in temperature that of the outer peripheral surface 38. The effect of this difference in temperature between the two surfaces coupled with the coefficient of thermal expansion and Young's modulus or stiffness creates a tensile stress in the outer peripheral surface 38 of the heating element assembly 10.

Applicants have concluded that, under operating conditions, the maximum permissible average thermal stress in the sheath 24 should not exceed some preselected amount of the modulus of rupture (also known as the four-point bend strength) of the sheath material. The following equation was developed to predict resistance to failure caused by thermal stress:

$$\sigma = \frac{(\alpha)(E)(t)(Q/A)}{k} = (f)(MOR)$$

where $\sigma$=maximum average thermal stress (MPa)

$\alpha$ = coefficient of thermal expansion (mm/mm °C.) of sheath 24

E = modulus of elasticity (MPa) of sheath 24 t = thickness (mm) of annular wall 30 of sheath 24 in the direction of heat flux Q/A = heat flux (W/mm$^2$) through the annular wall 30 of sheath 24 k = thermal conductivity (W/mm °C.) of sheath 24 f = preselected factor

MOR = modulus of rupture or four-point bending strength (MPa) of sheath 24.

A two-dimensional finite element model computer program was used to identify the temperature gradients in the sheath 24 and to determine the thermal stresses which those temperature gradients create. Such modeling showed that the thickness t of the annular wall 30 should be made as thin as practical in order to reduce the thermal stresses to a satisfactorily low level. Thus, the above equation is rearranged by solving for t:

$$t = \frac{(f)\,(MOR)\,(k)}{(\alpha)\,(E)\,(Q/A)}$$

In order to solve the equation for a given material, quantitative values for the preselected factor (f) and heat flux are selected and inserted into the equation. The factor f effectively represents a margin of safety against failure caused by thermal stresses. The value for f may be selected from numbers greater than zero and equal to or less than one. For example, a value of f equals one would result in no margin of safety. To provide an adequate margin of safety under steady-state operating conditions, f may be selected to be about 0.5. However, due to the existence of transient conditions, it is preferable to select a more conservative value for f which is less than about 0.5 (for example, f equals about 0.25).

Several examples now follow where f is chosen to be 0.25 and Q/A is chosen to be 0.371 W/mm$^2$. It should be noted that, ideally, data on material properties should be obtained at the operating condition of interest. Thus, to the extent such data is available, the material properties for the sheath in each example are given at the exemplary operating temperature of about 1200° C./2192° F. On the other hand, some of the examples involve material properties for which data is not available at the exemplary operating temperature. The data and results in these examples should be carefully considered to determine if it would be valid to extrapolate results for the exemplary operating temperature.

EXAMPLE NO. 1

| | |
|---|---|
| material | silicon nitride [$Si_3N_4$] (Kyocera SN 220M) |
| E | 270,400 MPa @ 1200° C. |
| $\alpha$ | 0.0000036 mm/mm° C. @ 1200° C. |
| k | 0.0153 W/mm° C. @ 1200° C. |
| MOR | 400 MPa @ 1200° C. |
| t | 4.24 mm |

EXAMPLE NO. 2

| | |
|---|---|
| material | sialon [SiAlON] |
| E | 300,000 MPa @ 20° C. |
| $\alpha$ | 0.00000304 mm/mm° C. @ 1000° C. |
| k | 0.0213 W/mm° C. @ 20° C. |
| MOR | 400 MPa @ 1200° C. |
| t | 6.30 mm |

EXAMPLE NO. 3

| | |
|---|---|
| material | aluminum oxide [$Al_2O_3$] |
| E | 268,000 MPa @ 1200° C. |
| $\alpha$ | 0.0000085 mm/mm° C. @ 1200° C. |
| k | 0.006 W/mm° C. @ 1200° C. |
| MOR | 20 MPa @ 1200° C. |
| t | 0.035 mm |

EXAMPLE NO. 4

| | |
|---|---|
| material | aluminum oxide with 10% silicon carbide whiskers [$SiC_2$—$Al_2O_3$] |
| E | 170,000 MPa @ 1200° C. |
| $\alpha$ | 0.000007 mm/mm° C. @ 1200° C. |
| k | 0.0065 W/mm° C. @ 1200° C. |
| MOR | 178 MPa @ 1200° C. |
| t | 0.65 mm |

EXAMPLE NO. 5

| | |
|---|---|
| material | sintered mullite [$3Al_2O_32SiO_2$] |
| E | 100,000 MPa @ 1200° C. |
| $\alpha$ | 0.000005 mm/mm° C. @ 1200° C. |
| k | 0.004 W/mm° C. @ 1200° C. |
| MOR | 150 MPa @ 1200° C. |
| t | 0.81 mm |

EXAMPLE NO. 6

| | |
|---|---|
| material | cordierite [magnesium aluminosilicate] |
| E | 61,000 MPa @ 20° C. |
| $\alpha$ | 0.0000028 mm/mm° C. @ 1200° C. |
| k | 0.0007 W/mm° C. @ 20° C. |
| MOR | 55 MPa @ 20° C. |
| t | 0.15 mm |

EXAMPLE NO. 7

| | |
|---|---|
| material | aluminum titanate [$Al_2TiO_5$] |
| E | 20,000 MPa @ 1000° C. |
| $\alpha$ | 0.00000153 mm/mm° C. @ 1200° C. |
| k | 0.00209 W/mm° C. @ 1200° C. |
| MOR | 120 MPa @ 1200° C. |
| t | 0.55 mm |

EXAMPLE NO. 8

| | |
|---|---|
| material | beryllium oxide [BeO] |
| E | 344,740 MPa @ 20° C. |
| $\alpha$ | 0.00001017 mm/mm° C. @ 1200° C. |
| k | 0.0178 W/mm° C. @ 1200° C. |
| MOR | 207 MPa @ 20° C. |
| t | 0.71 mm |

It is emphasized that ceramic materials are brittle and, consequently, the stress at any part of the sheath cannot exceed the material strength at that location. In other words, the materials are not forgiving and will not yield as would a metal to reduce the local stress. Instead, the sheath will simply fail by fracturing. It is also noted that the strength actually varies throughout the ceramic sheath. Consequently, the design of a ceramic sheath 24 requires the use of statistical data such as Weibull modulus and the reliability and durability are expressed as a probability of failure. While the last equation above provides the designer with a tool by which the designer can evaluate other candidate materials which have been found to pass Applicants' recommended corrosion test and gas impermeability criteria, accurate design will require the use of advanced analysis tools such as finite element analysis to gain high confidence in the temperatures and probability of failure of the heating element assembly. The above equation may also be used to evaluate non-ceramic materials for the sheath 24.

The last equation above can be used to weigh the trade-offs between the various material properties. For example, plain aluminum oxide ($Al_2O_3$) was one of the first ceramic materials that Applicant considered for the sheath material because it exhibits excellent corrosion resistance. However, Applicants found that a prototype ceramic sheath formed of this material cracked after only a few hours of operation in an engine test. Example No. 3 above also indicates that plain aluminum oxide is an unsuitable material with respect to its ability to survive thermal stresses. When the material property values of plain aluminum oxide are substituted into the last equation above, they produce a maximum allowable thickness t for the sheath annular wall 30 which is too thin to manufacture as well as too thin to withstand mechanical loadings that a glow plug would typically experience in an engine combustion chamber.

Example No. 4 illustrates how the addition of silicon fiber whiskers improves the thermal stress properties of aluminum oxide. This relatively new composite ceramic, called silicon-carbide-whisker-reinforced alumina ($SiC_w$-$Al_2O_3$), was developed by Arco Chemical Company and used primarily for machine tool bits. The addition of the whiskers changes the material properties of that ceramic in a way that substantially improves its thermal shock resistance. The calculated maximum permissible thickness t also indicates that if this material is formed as a solid piece, similar to the silicon nitride insulator which embeds the heating filament shown in the Yokoi patent, it would not possess sufficient thermal and mechanical properties to survive in an engine combustion chamber.

At the present time, silicon-carbide-whisker-reinforced aluminum oxide is Applicants' preferred material for the sheath 24 and it has been proven successful in bench and engine tests. For example, Applicants have successfully made and tested a sheath 24 made of this material which has an annular wall thickness of about 0.5 millimeters/0.02 inches. This annular wall thickness was conservatively chosen to be below the upper limit of 0.65 millimeters/0.03 inches given in Example No. 4 in order to enhance the factor of safety against failure by thermal stresses. On the other hand, this annular wall thickness is sufficient to be practical for manufacturing the sheath 24 as a monolithic piece. This annular wall thickness is also sufficient to provide enough strength for assembling the sheath 24 to the glow plug body and also for surviving the mechanical loading the sheath 24 would experience in an engine combustion chamber. The composite material for the sheath 24 contained about 5 to 40 percent by volume of silicon carbide whiskers and about 95 to 60 percent by volume of aluminum oxide. The silicon carbide whiskers were single crystals having a length of about 5 to 200 microns long and a diameter of about 0.1 to 3 microns.

Example No. 7 suggests that aluminum titanate ($Al_2TiO_5$) might be a promising material from the standpoint of surviving thermal stresses. However, it is deemed to be an unsuitable material for this application because it is not substantially gas impermeable (i.e., its porosity would simply allow corrosive combustion gases to pass through the sheath and attack the heating means 26) and also because its material properties become unstable at high temperatures.

A monolithic sheath 24 can be formed by pressing, slip-casting, injection-molding, or extruding a mixture of the silicon carbide whiskers, aluminum oxide powder, water, and organic binders. In order to make the sheath 24 substantially imperforate, the sheath 24 is then densified (typically to greater than 95% of theoretical density) by sintering, hot-pressing, or hot-isostatic-pressing. If necessary, the final outside diameter of the outer peripheral surface 38 as well as its substantially-smooth profile, inside diameter of the blind bore 34 as well as its substantially smooth profile, the rounded profile of closed end portion 32, and chamfer at the open end portion 31 of the blind bore 34 are formed such as by a machining operation.

Other ceramic oxide materials may also give an acceptable low probability of failure. Mullite is not as strong as aluminum oxide, but it has a lower coefficient of thermal expansion and modulus of elasticity which effectively give a lower calculated thermal stress for a given thickness t of the sheath annular wall 30. Also, silicon carbide whiskers can be added to the mullite matrix to increase the strength of the composite. Beryllium oxide is another material which has a relatively-low strength, but it has a relatively high thermal conductivity and modulus of rupture which collectively make it a promising material. Hafnium titanate and cordierite are materials whose respective low strengths can be offset by their respective extremely low coefficients of thermal expansions. Silicon nitride, sialon, and silicon carbide have material properties which give low calculated stresses, but these materials have low resistance to corrosion which eliminate them as suitable materials for the sheath 24.

Many other ceramic materials (mostly ceramic oxide materials) may be suitable candidates as the material forming the sheath 24. Such suitable materials include plain aluminum oxide, titanium oxide, yttrium oxide, sodium zirconium phosphate, and chromium oxide densified aluminum oxide. The process of making chromium oxide densified aluminum oxide is disclosed in U.S. Pat. No. 3,956,531 issued to Church et al. on May 11, 1976. If necessary, these materials may be reinforced with ceramic material in the form of particulates or whiskers selected from the group of oxides, carbides, nitrides, and borides such as zirconium oxide, silicon carbide, silicon nitride, and titanium boride.

The function of the heating means 26 is to provide the energy required to maintain the temperature of the outer peripheral surface 38 of the sheath 24 at the preselected very high temperature (for example, about 1200° C./2192° C.) This energy must be provided at a rate that compensates for the loss of energy from the sheath 24 caused by convection, radiation and conduction to the glow plug body. The heating means 26 should be selected so that the heating means 26 does not impart appreciable stress to the sheath 24 during thermal expansion and/or contraction. However, since the heating means 26 is covered by the protective sheath 24, suitable materials for the heating means 26 do not need to be corrosion resistant.

FIG. 1 shows a first exemplary embodiment of the heating element assembly 10 wherein the heating means 26 includes a monolithic electrically nonconductive insulator 40 and a heating filament 42.

Preferably, the insulator 40 has a generally cylindrical shape and includes a mandrel 44 and an inner sheath 46. The mandrel 44 includes a helical groove 48 formed around its outer peripheral surface and a central bore 49 extending along its longitudinal axis. The groove 48 is arranged as a single helix which preferably has two or more pitches.

Preferably, the heating filament 42 is formed from a continuous single strand of wire formed from a refractory resistance-heating material such as molybdenum, nichrome, alumel, chromel, platinum, tungsten or similar noble metal, tantalum, rhodium, molybdenum disilicide, rhenium, or platinum-rhodium alloys. In the embodiment of FIG. 1, one portion of the heating filament 42 is positioned in the groove 48 of the mandrel 44 and thereby arranged as a single helix. One end portion of the helix, adjacent to the closed end portion 32 of the sheath 24, preferably has a pitch which is finer (i.e., more windings per axial length) than the pitch of the opposite end portion of the helix, adjacent to the open end portion 31 of the sheath 24. Another portion of the heating filament 42 is relatively straight and extends through the central bore 49 of the mandrel 44 in radially inwardly spaced relation to the helical windings of the heating filament 42. Alternatively, the heating filament 42 may be arranged according to other known configurations, such as a double helix, without departing from the present invention.

Preferably, each end portion of the heating filament 42 is connected to a respective lead wire 18, 20. The lead wires 18,20 are spaced apart from one another and a portion of each lead wire is embedded in the insulator 40. The lead wires 18, 20 extend out of the insulator 40 and through the open end portion 31 of the sheath 24. Preferably each lead wire 18,20 is formed of tungsten and has a cross-sectional diameter which is substantially larger than the cross-sectional diameter of the heating filament 42.

The materials for the heating means 26 and sheath 24 should be chosen so that thermal growth and contraction of the heating means 26 is compatible with thermal growth and contraction of the sheath 24. Such thermal compatibility between the sheath 24 and the insulator 40 ensures that the insulator 40 does not induce mechanical stresses into the sheath 24 by outgrowing the confines of the sheath 24 during thermal expansion and contraction.

Preferably, the insulator 40 is formed from any of several ceramic materials, such as silicon nitride ($Si_3N_4$), Sialon (SiAlON), or aluminum nitride (AlN) and may include a densification aid such as magnesium oxide. Suitable materials for the insulator 40 should be electrically non-conductive, thermally conductive and highly resistant to thermal stresses. The material should also be capable of being formed as a monolithic piece which embeds and hermetically seals the heating filament 42 from the effects of oxidation. As previously mentioned, one should also consider the desired thermal expansion as well as thermal conductivity needed for compatibility with the rest of the heating element assembly 10. For example, the insulator 40 may be formed from silicon nitride ($Si_3N_4$ ) when the sheath 24 is formed from an aluminum oxide based ceramic material such as silicon-carbide-whisker-reinforced alumina ($SiC_w$-$Al_2O_3$).

The subassembly of the heating filament 42, insulator 40, and a portion of the lead wires 18,20 is positioned in the blind bore 34 of the sheath 24 in generally concentrically spaced relation to the inner peripheral surface 36.

The heat transfer means 28 is interposed between the heating means 26 and the inner peripheral surface 36 of the sheath 24. The heat transfer means 28 performs two primary functions. One function is to support the heating means 26 within the blind bore 34 of the sheath 24. The other function is to provide a means for efficient heat transfer from the heating means 26 to the inner peripheral surface 36 of the sheath 24. Such heat transferred to the sheath 24 then passes through the annular wall 30 of the sheath 24 to maintain the the outer peripheral surface 38 at the preselected very high temperature.

In FIG. 1, the heat transfer means 28 includes filler material 62. The filler material 62 is disposed in the blind bore 34 of the sheath 24 and completely fills the remaining space between the heating means 26 and the sheath 24. The filler material 62 is formed of a heat conductive material which is adapted to readily transfer the heat generated by the heating filament 42 to the outer peripheral surface 38 of the sheath 24 when the heating element assembly 10 is electrically energized. Preferably, the filler material 62 is a cement formed from calcium aluminate and distilled water. Other filler materials may be substituted including zirconium silicate cement, aluminum oxide powder, magnesium oxide powder, or any of the above materials with additions (about 5 to 40% by volume) of silicon carbide, platinum, or molybdenum particulate to make the filler material more thermally conductive.

Figure 2:
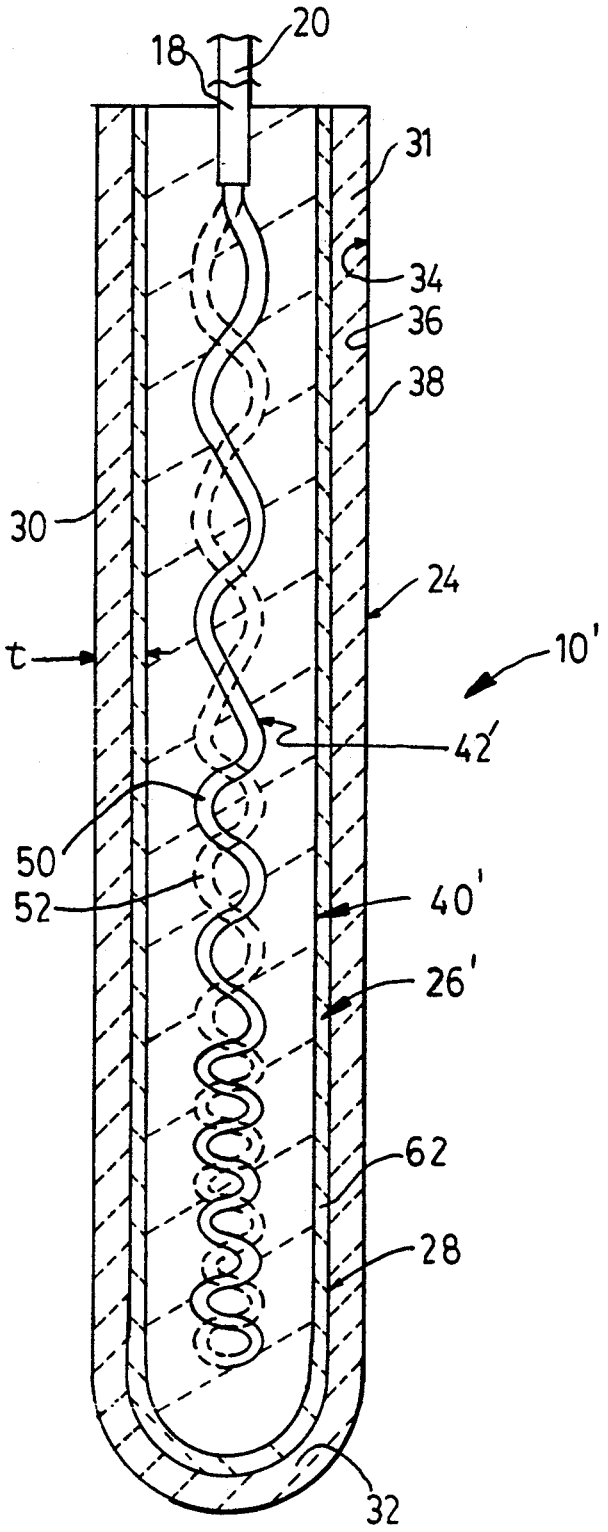
FIG. 2 is a diagrammatic view similar to FIG. 1 but showing a second exemplary embodiment of the present invention.
Figure 3:
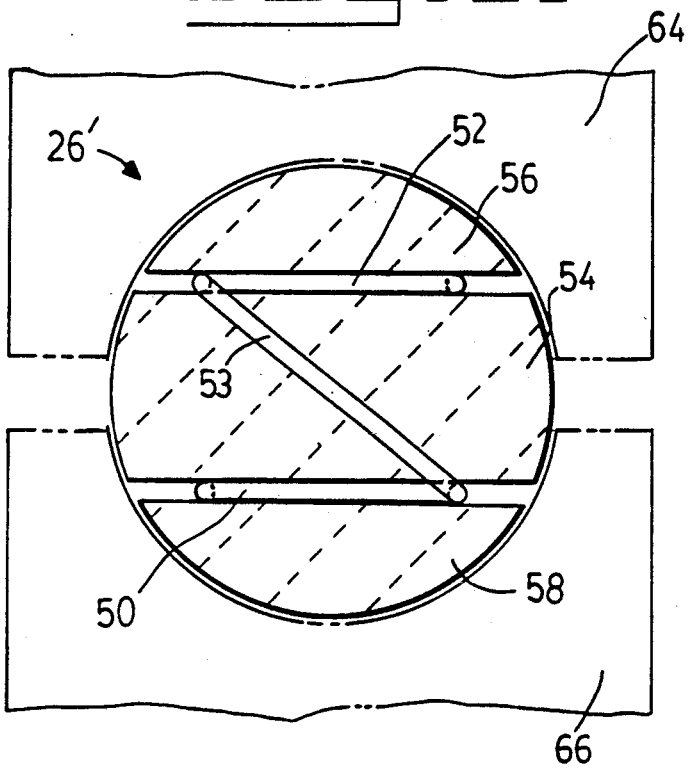
FIG. 3 is a diagrammatic enlarged view of one end portion of the heating means of FIG. 2 during a stage of assembly.
Figure 4:
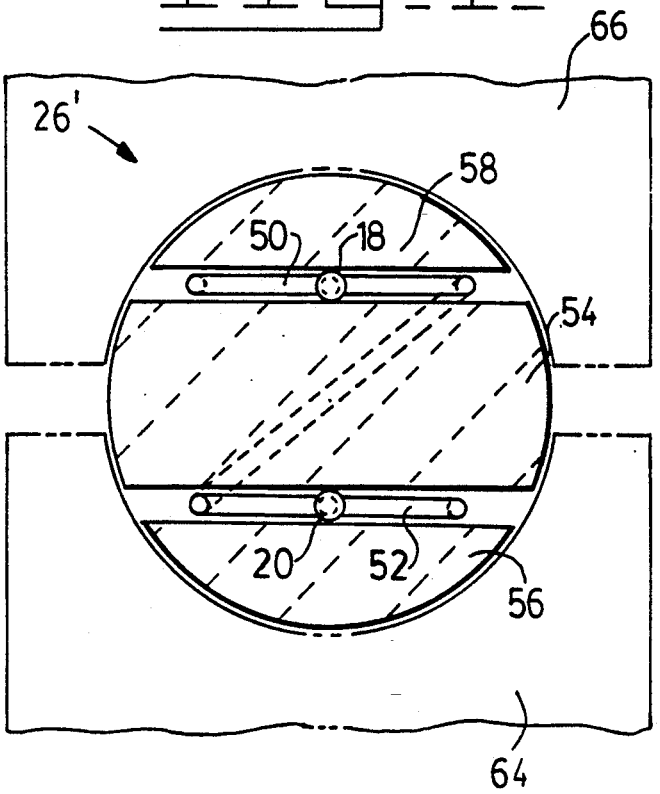
FIG. 4 is a diagrammatic enlarged view of another end portion of the heating means of FIG. 2 during a stage of assembly.

FIGS. 2–4 show a second exemplary embodiment of the heating element assembly 10'. The heating element assembly 10' is similar to the heating element assembly 10 of FIG. 1 except for the configuration of the heating means 26' and how it is formed. In this embodiment, the heating filament 42' is a generally U-shaped continuous wire which is undulated or corrugated. The generally U-shape of the heating filament 42' defines a pair of spaced apart legs 50,52 and a connecting portion 53. Moreover, the insulator 40' is initially formed from a plurality of ceramic pieces which include an intermediate piece or shim 54 and a pair of outer pieces 56,58. Preferably, the pieces 54,56,58 are individually shaped so that they collectively form a cylindrical shape when when assembled together.

Industrial Applicability

A brief description of various methods of manufacturing the improved heating element assembly 10,10' and its operation will now be discussed.

In first exemplary embodiment of FIG. 1, the mandrel 44 is preferably formed by injection molding. During the molding process the helical groove 48 is formed about the periphery of the mandrel 44 and the relatively small central bore 49 is formed by a pin which is extracted before the mold is opened. Moreover, a pair of oppositely spaced apart axial slots are formed on the peripheral surface of the mandrel 44 on the end where the lead wires 18, 20 are to be attached. One of the slots is connected to a passage which radially inwardly intersects the central bore 49.

One end portion of the heating filament 42 is connected to the lead wire 18 by, for example winding, welding or swaging. The free end of the heating filament 42 is then fed through the central bore 49 until the lead wire 20 snaps into place in the slot which intersects the central bore 49. The lead wire 18 is then similarly connected to the other end portion of the heating filament 42. The heating filament 42 is then wound around the mandrel 44 so that the coils are positioned in the molded grooves 48. The lead wire 18 is then snapped into place in the second axial slot. The inner sheath 46, which had been previously injection molded but is still unfired, is then slipped over the above subassembly with a portion of each lead wire 18,20 protruding. Then a temporary boot, preferably formed of tantalum or other refractory ductile material, is temporarily slipped over the above subassembly so that the temporary boot extends beyond the free ends of the lead wires 18,20. The temporary boot may be axially fluted or corrugated to provide radial/tangential resilience and is pinched down to a flat surface beyond the free end portions of the lead wires 18,20. The pinching just described resembles a pinched end of a drinking straw.

The assembly is then heated to drive off organic binder, if any is present, and then the end of the temporary boot is hermetically sealed by a clamp or other device. The assembly is then loaded into a hot isostatic press (HIP) autoclave and the temperature of the autoclave is then raised to about 1371° C./2500° F. and about 20690 kPa/3000 psi. The assembly remains in the autoclave at this high pressure and temperature for about an hour. The assembly is then removed from the autoclave and the temporary boot is opened and the hot isostatically pressed subassembly (consisting of the lead wires 18,20; insulator 40; and heating filament 42) is removed.

The relatively thin walled monolithic configuration of the sheath 24 is controlledly formed to its final shape separate from the heating means 26. The relatively smooth and simple shape of the sheath 24 is virtually free of stress concentrators and is relatively easy to manufacture by, for example, slip-casting, hot pressing, injection molding, or selectively machining solid bar stock.

The filler material 62 is formed by creating a thin mixture of about 250-mesh calcium aluminate cement and distilled water. About two milliliters of distilled water per gram of calcium aluminate provides the preferred consistency for the wet cement that is created. This wet cement is poured into a syringe and excess air is purged therefrom. The injection tip of the syringe is inserted down at the bottom of the empty bore 34 of the sheath 24 and the wet calcium aluminate cement is injected until the blind bore 34 of the sheath 24 is filled.

The heating means 26 (which in FIG. 1 is the subassembly of the insulator 40, embedded heating filament 42, and embedded portion of the lead wires 18,20) is now inserted into the blind bore 34 of the sheath 24. The heating means 26 is immediately pushed all the way down into the blind bore 34 before drying and solidifying of the filler material occurs. The heating element assembly 10 is then x-rayed to ensure that the heating means 26 extends adjacent to the bottom of the blind bore 34 and that there are no electrical shorts or breaks in the electrical circuit defined by the lead wires 18,20 and the heating filament 42. The heating element assembly 10 is then cured overnight in a humid environment. This can be accomplished by placing the heating element assembly 10 in a humidity chamber. After curing, the heating element assembly 10 is dried, for example, in an oven to remove moisture.

A method of assembling the second exemplary embodiment of the heating element assembly 10', shown in FIGS. 2–4, will now be discussed.

The undulated legs 50,52 of the generally U-shaped heating filament 42' are positioned on oppositely facing surfaces of the intermediate piece 54 as shown in FIGS. 3 and 4. At this stage of manufacture, the intermediate piece 54, as well as the outer pieces 56,58, are in their green or unfired state. The outer pieces 56,58 are positioned against opposite faces of the intermediate piece 54 so that each leg 50,52 of the heating filament 42' is sandwiched therebetween. At this stage of assembly, the three pieces of the insulator 40 collectively resemble a nearly cylindrical shape as shown in FIGS. 3 and 4. The organic binder in the insulator 40' is burned out and the heating means 26' is hot pressed in a temporary boot between a pair of heated dies 64,66. The heating means 26 is then positioned in the sheath 24 and potted with filler material 62 similar to the embodiment of FIG. 1.

Figure 5:
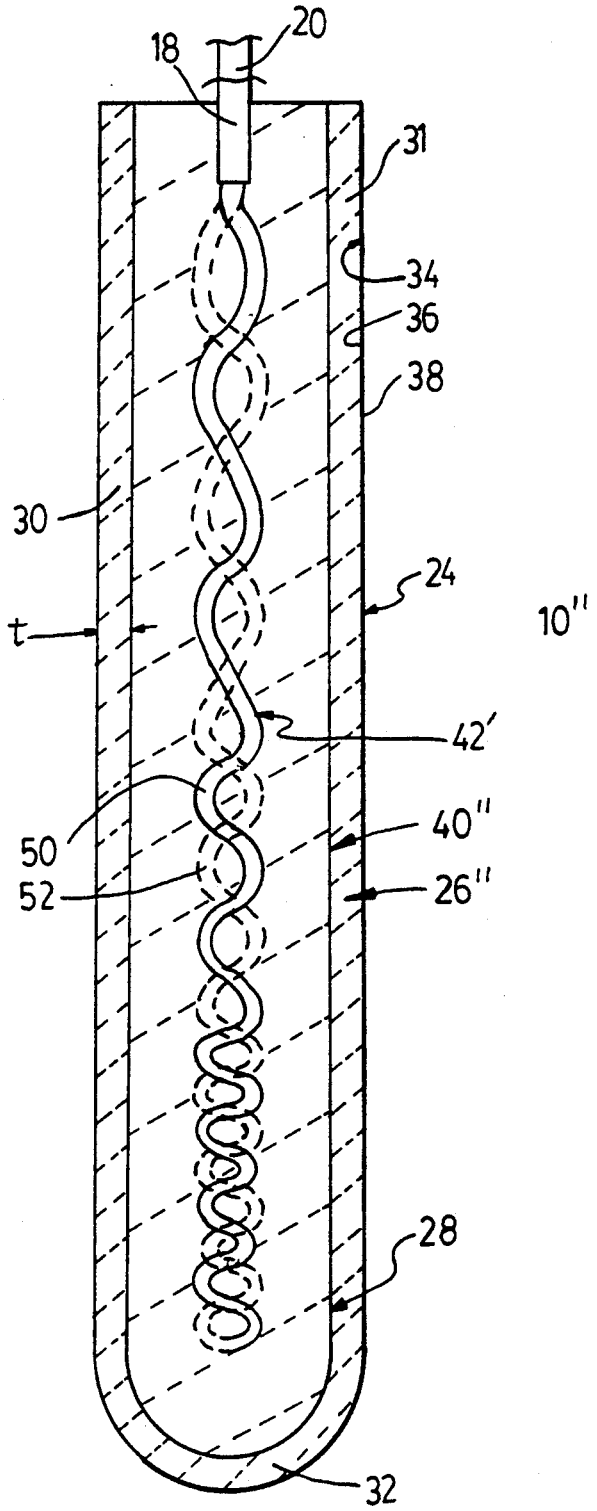
FIG. 5 is a diagrammatic view similar to FIG. 2 but show a third exemplary embodiment of the present invention.

Alternatively, as shown in FIG. 5, the filler material 62 in FIG. 2 may be eliminated by incorporating an unfired sheath 24 into the HIP process. The sheath 24 in its unfired state is slipped directly onto the subassembly 42',40'',54,56,58 before the temporary boot is applied and the HIP process is begun. In this case, the resultant direct surface contact between the sheath 24 and the heating means 26''' serves as the heat transfer means 28.

In operation of the glow plug 10 shown in FIG. 1, electrical current flows into the lead wire 18, through the heating filament 42, and out through the lead wire 20. The relatively smaller diameter of the heating filament 42 creates relatively more electrical resistance in the heating filament than elsewhere in the electrical circuit and therefore generates heat. This heat is readily communicated by the filler material 62 to the outer peripheral surface 28 of the sheath 24 in order to assist ignition of fuels which do not readily auto-ignite.

Compared to known planar heating filaments, the circumferentially symmetric arrangement of the heating filament 42 within the sheath 24 results in a more uniform or circumferentially symmetric distribution of heat (generated by the heating filament 42) onto the outer peripheral surface 28 of the sheath 24. The relatively finer pitch coils of the heating filament 42 concentrate the heat generated by the glow plug 12 at the free end portion of the heating element assembly 10. The relatively coarser pitch filament windings of the heating filament 42 provide a relatively smooth temperature transition between the relatively straight electrical leads in the glow plug body and the relatively finer pitch filament windings. Such transition helps ensure that there is not a sharp temperature gradient along the longitudinal axis of the heating element assembly 10.

Improved corrosion and oxidation resistance is provided by the protective sheath made from a carefully selected ceramic material. For example, 1 to 2 orders in magnitude of improved sodium corrosion resistance are obtained with alumina-based ceramic materials compared to silicon nitride based materials. Moreover, thermal shock resistance as well as strength is improved by reinforcing various ceramic materials with particulate material. Applicants' design methodology is advantageous for screening and selecting suitable materials for the sheath 24.

The improved heating element assembly may, for example, be incorporated in a glow plug which is continuously energized in an operating internal combustion engine to ensure ignition of relatively lower cetane number fuels. This design helps to protect glow plug heating element assemblies in a very severe environment so that they may experience a longer life than that experienced by previously known glow plug heating element assemblies. This improved heating element assembly may also be used other combustion applications, such as industrial furnaces, where a relatively durable surface-ignition element is required to initiate or assist combustion of fuels.

Other aspects, objects, and advantages of this invention can be obtained from a study of the drawings, the disclosure, and the appended claims.

We claim:

1. A heating element assembly adapted for a glow plug comprising:

a monolithic, refractory, corrosion-resistant, substantially-gas-impermeable, ceramic sheath, said sheath including a relatively-thin and annular wall having an open end portion and a closed end portion defining a blind bore;

heating means for emitting heat, said heating means positioned in the blind bore of the sheath and adapted to be connected to a source of energy, said heating means including an electrical resistance heating filament and a monolithic ceramic insulator, said heating filament being hermetically sealed in the insulator; and heat transfer means for transferring heat from the heating means to the sheath.

2. The heating element assembly of claim 1 wherein the sheath and heating means each have material properties and configurations which are selected in conjunction to prevent the maximum thermal and mechanical stresses in the sheath and the heating means from exceeding the minimum respective strengths of the materials forming the sheath and the heating means.

3. The heating element assembly of claim 1 wherein said annular wall of the sheath has a maximum allowable thickness ($t_{max}$) governed by the following relationship:

$$t_{max} = \frac{(f)(MOR)(k)}{(\alpha)(E)(Q/A)}$$

wherein $t_{max}$=maximum allowable thickness of annular wall of sheath in the direction of heat flux;

f=preselected factor greater than zero and equal to or less than one;

MOR=modulus of rupture of sheath;

k=thermal conductivity of sheath;

$\alpha$ =coefficient of thermal expansion of sheath;

E=modulus of elasticity of sheath; and

Q/A=heat flux.

4. The heating element assembly of claim 1 wherein said sheath is substantially formed of a ceramic oxide material.

5. The heating element assembly of claim 1 wherein said sheath is substantially formed of a composite ceramic oxide material.

6. The heating element assembly of claim 5 wherein said sheath is reinforced with ceramic material in the form of particulates selected from the group of oxides, carbides, nitrides, and borides.

7. The heating element assembly of claim 1 wherein said sheath is substantially formed of a ceramic material selected from the group of reinforced aluminum oxide, beryllium oxide, titanium oxide, yttrium oxide, mullite, sodium zirconium phosphate, chromium oxide densified aluminum oxide, and aluminum titanate.

8. The heating element assembly of claim 1 wherein said heating filament is formed of an electrically-conductive refractory material selected from the group of molybdenum, nichrome, alumel, chromel, platinum, tungsten, tantalum, rhodium, molybdenum disilicide, rhenium, and platinum-rhodium alloy.

9. The heating element assembly of claim 1 wherein said heating filament is a continuous strand of wire having a pair of end portions, said heating element assembly further including a pair of electrical lead wires, each of said lead wires connected to a respective end portion of the heating filament and partially embedded in the insulator, said lead wires extending out the open end portion of the sheath.

10. The heating element assembly of claim 1 wherein said insulator is substantially formed from a ceramic.

11. The heating element assembly of claim 1 wherein said insulator is substantially formed from a ceramic selected from the group of silicon nitride ($Si_3N_4$), Sialon (SiAlON) and Aluminum nitride (AlN).

12. The heating element assembly of claim 1 wherein said heat transfer means includes a refractory thermally-conductive filler material positioned in the blind bore between the heating means and the sheath.

13. The heating element assembly of claim 1 wherein said sheath has an inner peripheral surface which defines the blind bore and directly contacts the insulator.

14. A heating element assembly adapted for a glow plug comprising:

a cylindrical monolithic, refractory, corrosion-resistant, substantially-gas-impermeable, ceramic sheath, said sheath including a relatively-thin and smooth annular wall having a closed end portion and defining a blind bore;

heating means for emitting heat, said heating means positioned in the blind bore of the sheath and adapted to be connected to a source of energy, said heating means including a heating filament formed of a continuous single strand of wire hermetically sealed in a non-oxide ceramic insulator; and heat transfer means for transferring heat from the heating means to the sheath when the glow plug heating element assembly is electrically energized.

15. A heating element assembly adapted for a glow plug comprising:

a monolithic, refractory, corrosion-resistant, substantially-gas-impermeable, sheath, said sheath including a relatively-thin and annular wall having a closed end portion and defining a blind bore, said annular wall of the sheath having a maximum allowable thickness ($t_{max}$) governed by the following relationship:

$$t_{max} = \frac{(f)(MOR)(k)}{(\alpha)(E)(Q/A)}$$

wherein $t_{max}$=maximum allowable thickness of annular wall of sheath in the direction of heat flux, f=preselected factor greater than zero and equal to or less than one, MOR=modulus of rupture of sheath, k = thermal conductivity of sheath,
$\alpha$ = coefficient of thermal expansion of sheath,
E = modulus of elasticity of sheath, and
Q/A = heat flux;

heating means for emitting heat, said heating means positioned in the blind bore of the sheath and adapted to be connected to a source of energy, said heating means including a heating filament hermetically sealed in a ceramic insulator; and heat transfer means for transferring heat from the heating means to the sheath.

* * * * *

UNITED STATES PATENT AND TRADEMARK OFFICE

CERTIFICATE OF CORRECTION

PATENT NO. : 5,084,606

DATED : January 28, 1992

INVENTOR(S) : JOHN M. BAILEY ET AL.

It is certified that error appears in the above-identified patent and that said Letters Patent is hereby corrected as shown below:

Claim 7, column 16, line 5, after "phosphate,", insert --and--.

Claim 7, column 16, line 6, after "aluminum oxide", delete ", and aluminum titanate".

Signed and Sealed this

Fourth Day of May, 1993

Michael K. Kirk

MICHAEL K. KIRK

*Acting Commissioner of Patents and Trademarks*

*Attest:*

*Attesting Officer*